United States Patent [19]

Kliem

[11] 4,347,301

[45] Aug. 31, 1982

[54] NOVEL DIFFUSION TRANSFER FILM UNITS

[75] Inventor: Peter O. Kliem, Weston, Mass.

[73] Assignee: Polaroid Corporation, Cambridge, Mass.

[21] Appl. No.: 210,808

[22] Filed: Nov. 26, 1980

[51] Int. Cl.[3] ..... G03C 5/54

[52] U.S. Cl. ..... 430/215; 430/217; 430/224; 430/502; 430/505; 430/509

[58] Field of Search ..... 430/215, 217, 509, 502, 430/505, 224

[56] References Cited

U.S. PATENT DOCUMENTS

| | | | |
|---|---|---|---|
| 3,188,209 | 6/1965 | Land et al. | 430/217 |
| 3,625,685 | 12/1971 | Autges et al. | 430/215 |
| 3,695,882 | 10/1972 | Kumai et al. | 430/17 |
| 3,785,815 | 1/1974 | Autges et al. | 430/215 |
| 3,960,558 | 6/1976 | Cardone | 430/217 |
| 4,003,744 | 1/1977 | Kliem | 430/217 |

FOREIGN PATENT DOCUMENTS 874046 8/1961 United Kingdom .

*Primary Examiner*—J. Travis Brown
*Attorney, Agent, or Firm*—Philip G. Kiely

[57] ABSTRACT

The present invention is directed to photosensitive elements and to diffusion transfer film units employing said elements wherein said photosensitive element includes a plurality of essential layers, including a first photosensitive silver halide layer and a second photosensitive silver halide layer, said first and second silver halide layers being sensitized to substantially the same spectral absorption range; a spacer layer intermediate and contiguous to said first and second silver halide layers, said spacer layer consisting essentially of inert particles which are substantially non-swelling in alkali, and substantially non-film forming; wherein said inert particles are equal to or less than the average diameter of the silver halide grains in said first and second silver halide layers and wherein said silver halide grains are 2.5 microns or less in average diameter; said first and second silver halide layers having associated therewith a dye image-forming material which is diffusible during processing as a function of the point-to-point degree of silver halide exposure to actinic radiation.

44 Claims, 1 Drawing Figure

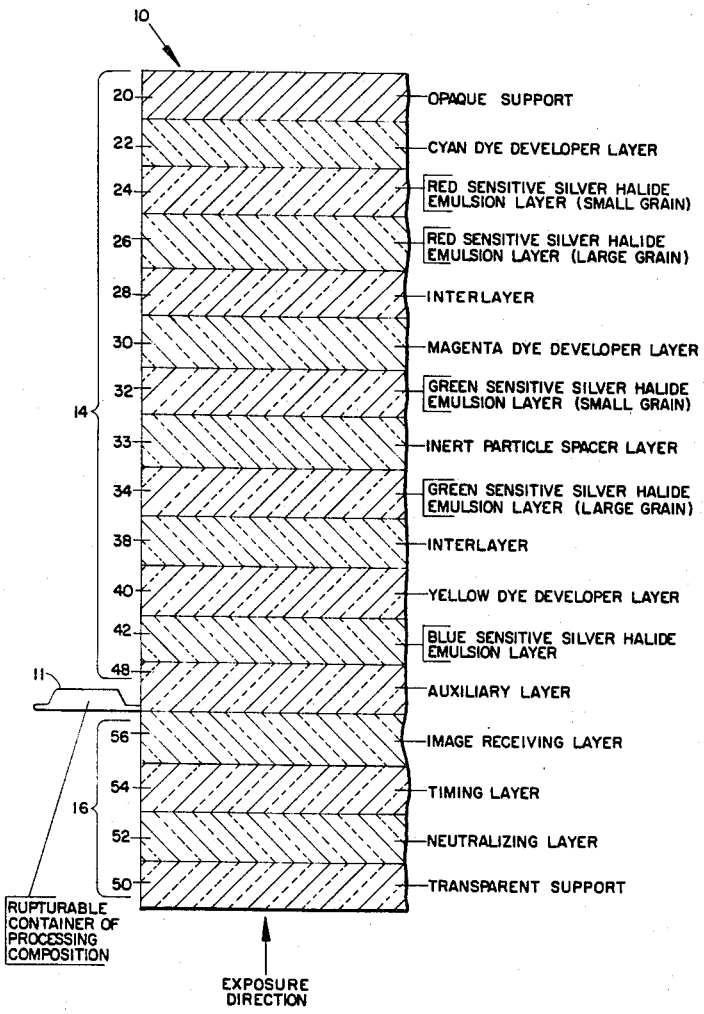

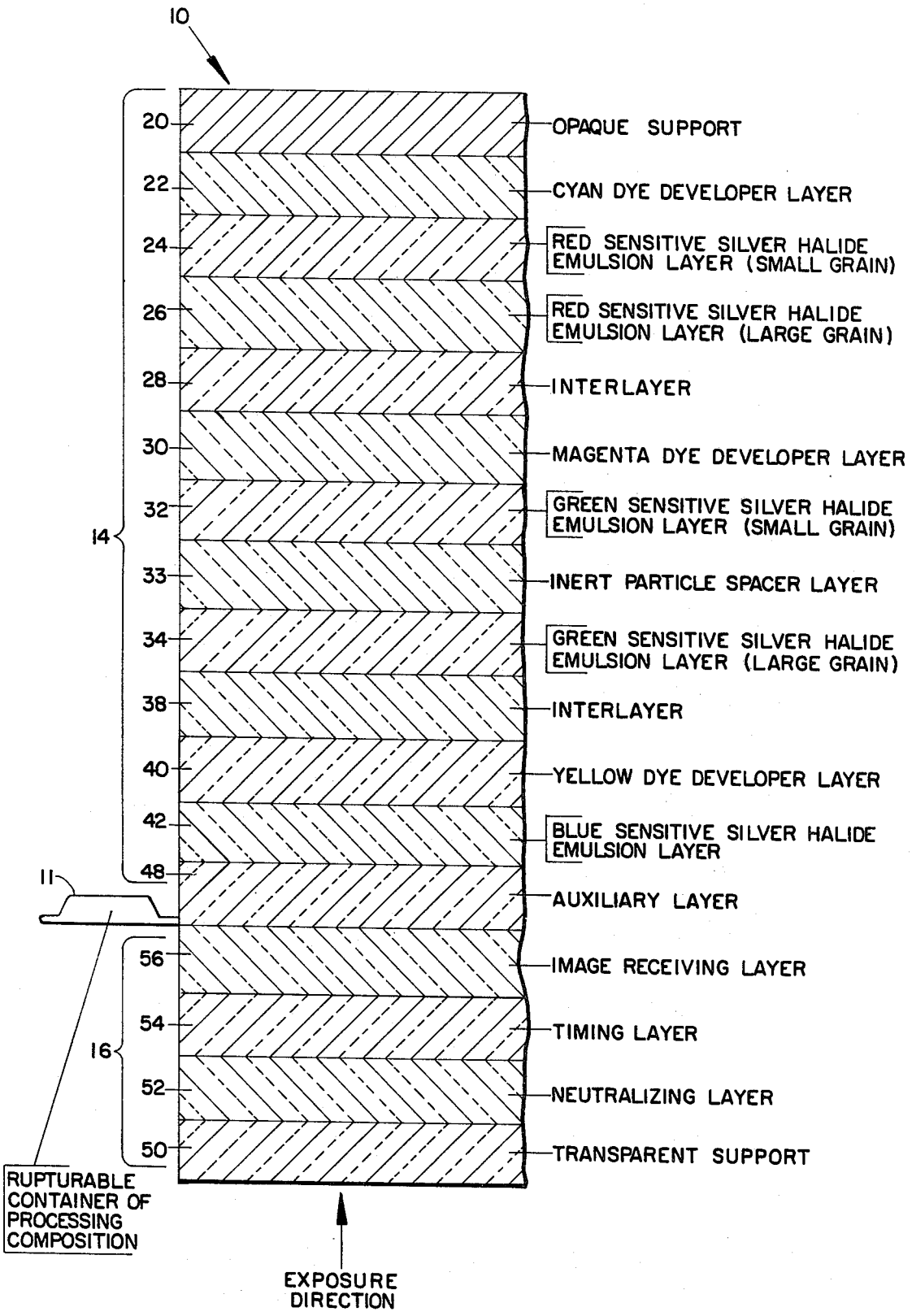
10
20
22
24
26
28
30
32
14
33
34
38
40
42
48
11
56
54
16
52
50
OPAQUE SUPPORT
CYAN DYE DEVELOPER LAYER
RED SENSITIVE SILVER HALIDE EMULSION LAYER (SMALL GRAIN)
RED SENSITIVE SILVER HALIDE EMULSION LAYER (LARGE GRAIN)
INTERLAYER
MAGENTA DYE DEVELOPER LAYER
GREEN SENSITIVE SILVER HALIDE EMULSION LAYER (SMALL GRAIN)
INERT PARTICLE SPACER LAYER
GREEN SENSITIVE SILVER HALIDE EMULSION LAYER (LARGE GRAIN)
INTERLAYER
YELLOW DYE DEVELOPER LAYER
BLUE SENSITIVE SILVER HALIDE EMULSION LAYER
AUXILIARY LAYER
IMAGE RECEIVING LAYER
TIMING LAYER
NEUTRALIZING LAYER
TRANSPARENT SUPPORT
RUPTURABLE CONTAINER OF PROCESSING COMPOSITION
EXPOSURE DIRECTION

NOVEL DIFFUSION TRANSFER FILM UNITS

BACKGROUND OF THE INVENTION

Diffusion transfer photographic products and processes are known to the art and details relating thereto can be found in U.S. Pat. Nos. 2,983,606; 3,415,644; 3,415,645; 3,415,646; 3,473,925; 3,482,972; 3,551,406; 3,573,042; 3,573,043; 3,573,044; 3,576,625; 3,576,626, 3,578,540; 3,569,333; 3,579,333; 3,594,164; 3,594,165; 3,597,200; 3,647,437; 3,672,486; 3,672,890; 3,705,184; 3,752,836; 3,857,865, all of which are incorporated here in their entirety. Essentially, diffusion transfer photographic products and processes involve film units having a photosensitive system including at least one silver halide layer, usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of the image-receiving element from the photosensitive system. In other products, however, such separation is not required and instead the transfer image-receiving layer is viewed against the reflecting background usually provided by a dispersion of a white reflecting pigment, such as, for example, titanium dioxide. The latter type of film unit is generally referred to in the art as integral negative-positive film units and are described, for example, in the above mentioned U.S. Pat. Nos. 3,415,644 and 3,594,165.

Film units containing contiguous silver halide emulsion layers sensitive to the same spectral region are known to the art as shown by the following representative patents.

U.S. Pat. No. 3,505,068 is directed to a photographic element which contains overlying silver halide emulsions wherein the first emulsion is a regular silver haloiodide emulsion and the second contains grains which have an iodide-free shell and a silver iodide core.

U.S. Pat. No. 3,663,228 is directed to a photographic film unit having a plurality of silver halide emulsion layers divided into sets with each set of a different speed while the layers in each set have the same speed but are responsive to different spectral regions. Color filters may be disposed between the layers.

U.S. Pat. No. 3,695,882, is directed to a photosensitive element comprising a support carrying two emulsions, each containing a non-diffusing color coupler. Each emulsion has a different speed and different silver halide-coupler molar ratio. An intermediate layer between the two emulsions is also disclosed.

U.S. Pat. No. 3,846,135 is directed to a synergistic increase in the sensitivity of two superposed silver halide layers when the lower layer is less sensitive than the upper layer and has a maximum density of at least 1.5 compared to a maximum density of at least 0.9 for the upper layer. The lower layer is about 5 to 15$\mu$ thick.

U.S. Pat. Nos. 3,960,558 and 4,003,744 disclose diffusion transfer film units which employ split silver halide emulsions having dye image-forming material associated therewith and which, in fact, contain dye image-forming material in one of said contiguous layers.

U.S. Pat. No. 3,188,209 is directed to a diffusion transfer film unit wherein the photosensitive element comprises red, green and blue sensitive silver halide emulsion layers with cyan, magenta and yellow dye developers, respectively, associated with said emulsions, wherein each dye developer is positioned between and contiguous to two emulsion layers of the same spectral sensitivity, e.g., the cyan dye developer is positioned between and contiguous to two red sensitive emulsions.

British Pat. No. 874,046, discloses a diffusion transfer film unit which includes an image-receiving layer, and a dye-developer layer interposed and between two blue sensitive silver halide emulsions. After exposure and application of a processing composition, the film unit is brought into superposition with a second image receiving layer to provide a dye image in each receiving layer.

Copending application Ser. No. 38,533, filed May 14, 1979, and commonly assigned, discloses and claims photographic film units which include a plurality of essential layers including at least one photosensitive silver halide layer comprising silver halide grains of a first mean particle size and a second photosensitive silver halide emulsion layer comprising silver halide grains of a second mean particle size; said first and second silver halide emulsion layers being in contiguous relationship with the first silver halide layer being distal to the exposure surface of the film unit; said first and second silver halide layers being free of dye image-forming material but having associated therewith a material which provides a dye image-forming material which is diffusible as a function of the point-to-point degree of silver halide exposure to actinic radiation. The silver halide layer comprises gelatin and inert particles which are compatible with gelatin, non-swelling in alkali and substantially non-film forming, wherein said inert particles are equal to or less than the silver halide grains in average diameter and wherein the silver halide grains are 2.5 microns or less in average diameter. Preferably, the inert particles are derived from a polymeric latex. The photosensitive elements are employed with a layer adapted to receive image-forming material diffusing thereto and means for applying an aqueous processing composition. The intrinsic speed of the second silver halide emulsion layer is preferably greater than that of the first silver halide emulsion layer.

SUMMARY OF THE INVENTION

The diffusion transfer film unit of the present invention comprises a plurality of layers which include a first silver halide emulsion layer and a second silver halide emulsion layer, wherein said first and second silver halide emulsions are sensitive to substantially the same spectral absorption range and have a dye image-forming material associated therewith; and a spacer layer intermediate and contiguous to said first and second silver halide layers; said spacer layer comprising inert particles which are substantially non-swelling in alkali and substantially non-film forming; wherein said inert particles are equal to or less than the silver halide grains in said first and second silver halide layers in average diameter and wherein the silver halide grains in said first and second silver halide layers are 2.5 microns or less in average diameter.

Preferably, said first silver halide layer contains silver halide grains of a first mean particle size and said second silver halide layer contains grains of a second mean particle size.

BRIEF DESCRIPTION OF THE DRAWINGS

The FIGURE is an enlarged, diagrammatic, cross-sectional view of a novel film unit within the scope of the present invention.

DETAILED DESCRIPTION OF THE INVENTION

The processes involved in the present invention may be easily described with respect to dye developers although it will be understood that other forms of dye image-forming materials may be employed in the present invention.

A dye developer which is well known in the art and which acts as both a developer and as an image-forming dye is associated with its appropriate silver halide emulsion; for example, a cyan dye developer with a red sensitive silver halide layer; a magenta dye developer associated with a green sensitive silver halide emulsion layer; and a yellow dye developer associated with a blue sensitive silver halide emulsion layer. Before oxidation, the dye developer would be insoluble in water but soluble in aqueous alkali. A dye developer undergoing oxidation as a result of development of exposed silver halide would result in immobilization and the remaining unoxidized dye developer would diffuse to the dyeable image-receiving layer producing a positive image therein.

To achieve the advantages of a layered structure, or so-called split emulsion, the layers are separated to form the above-described first and second silver halide layers. Thus, the described first and second silver halide layers constitute a silver halide unit wherein both layers are sensitive to substantially the same spectral absorption range.

The split emulsions may possess different grain sizes, different halide content or different speeds or various combinations thereof. The only requirement is that they both be sensitive to substantially the same spectral absorption range.

It has now been found that by separating the two emulsion layers within a silver halide unit by an inert particle layer, separate from the emulsion layers, wherein the inert particles possess the same characteristics described above in connection with application Ser. No. 38,533, a number of advantages are derived.

As stated above, the split silver halide emulsion layers are separated by a layer consisting essentially of inert particles which are substantially non-swelling in aqueous alkali; which are compatible with gelatin; which possess a refractive index sufficiently close to that of gelatin to avoid undue light scattering; which are substantially non-film forming (film forming would further inhibit dye transfer) and which are sufficiently hard to retain their physical identity as individual particles in the presence of aqueous alkali and thus provide a non-swelling, sizeable mass.

Inert particles suitable for use in the present invention include cellulose esters such as cellulose acetate propionate, cellulose ethers such as ethyl cellulose; synthetic resins such as polyvinyl acetate, polycarbonates, homo and copolymers of styrene, such as α-methyl styrene and chlorostyrene, polyvinyl chloride, and polytetrafluoroethylene. The preferred inert particles for use in the present invention are polymethylmethacrylate and polystyrene and are provided for the film unit by disposing polymethylmethacrylate latex or polystyrene latex intermediate the split silver halide layers.

The film forming and hardness characteristics of polymers are properties associated with the glass transition temperature of the polymer. Thus, the Tg of the polymer should be above the temperature at which the polymer is dried. Preferably, the Tg is above 35° C., more preferably, above 60° C. In a particularly preferred embodiment, the Tg is above 100° C.

The average diameter of the inert particles should be no larger than the average diameter of the silver halide grains with which they are associated. In the present invention the maximum average diameter of the silver halide grains in either layer is about 2.5 microns or less and preferably less than 2.0 microns. Thus, the maximum average diameter of the inert particles is about 2.5 microns. The lower limit of the particles is determined by the fact that one should avoid packing of the particles which would impede dye transfer. Preferably, inert particles less than 0.075 microns in diameter would not be employed.

In a particularly preferred embodiment the inert particles have an average diameter which is 10–15% of the average diameter of the silver halide grains in each of the contiguous layers.

Inert particles in excess of 2.5 microns or larger than the silver halide grains in the contiguous layers, do not provide the desired sensitometric advantages, and in addition, often are not coatable or, if coated, produce disruption of the layers in the negative.

It should be understood that a small amount of binder material such as gelatin or polyacrylamide is preferably employed to provide adhesion of the particles and integrity to the layer. Care should be taken, however, to insure that the quantity employed does not interfere or impede dye transfer through the layer.

The polymer latex which provides the inert particles may be a homopolymer or a copolymer provided that the comonomers do not modify the copolymer to the extent that the required properties are not retained. Thus, it may be desirable to employ a comonomer to provide some hydrophilicity to the polymer to increase the cohesive strength of the layer. However, comonomers should not be of a quantity or type which would render the polymer film-forming.

By separating the respective silver halide emulsion layers with the above-described inert particle layer, the emulsion layer maintains their integrity with the silver halide grains retained in their own separate and distinct layers. In addition, the silver halide layers develop separately, i.e., function as independent photosensitive layers, as indicated by Developgraph studies.

The thickness of the inert particle spacer layer is not critical. It is only required that the layer be sufficiently thick to provide for adequate separation of the silver halide layers. Preferably, the spacer layer is 0.5 to 10 times (weight basis) as the individual silver halide layer. In a particularly preferred embodiment, the spacer layer is 4 times (weight basis) the individual silver halide layer.

The film units of the present invention may employ the inert particle spacer layer with any or all of the silver halide units. The silver halide units which do not employ the inert particle spacer may comprise, for example, conventional single layer gelatin/silver halide emulsions, the gelatin-inert particles/silver halide emulsions disclosed and claimed in copending application Ser. No. 38,533, or the split emulsions containing inert particles disclosed and claimed in above cited application Ser. No. 38,533.

The emulsion layers employed with the inert particle spacer may also contain inert particles as disclosed in application Ser. No. 38,533. Thus, a wide variety of combinations of silver halide emulsion layers may be employed in the present invention at the election of the operator.

Referring now to the FIGURE, a preferred film unit within the scope of the present invention is illustrated.

Film unit 10 comprises rupturable container 11, retaining, prior to processing, aqueous photographic processing composition; photosensitive element 14 and image-receiving element 16. Photosensitive element 14 comprises, in order, opaque support 20, cyan dye developer layer 22, red sensitive silver halide emulsion layer (small grain) 24, red sensitive silver halide emulsion layer (large grain) 26, interlayer 28, magenta dye developer layer 30, green sensitive silver halide emulsion layer (small grain) 32, latex particle spacer layer 33, green sensitive silver halide emulsion layer (large grain) 34, interlayer 38, yellow dye developer layer 40, blue sensitive silver halide emulsion layer 42 and auxiliary layer 43.

Image receiving element 16 comprises, in order, transparent support 50, neutralizing layer 52, timing layer 54 and image-receiving layer 56. Neutralizing layer 52 and timing layer 54 may also be located between support 20 and layer 22.

The structural integrity of film unit 10 may be maintained, at least in part, by the adhesive capacity exhibited between the various layers comprising the laminate at their opposed surfaces. However, the adhesive capacity exhibited at an interface intermediate image-receiving layer 56 and auxiliary layer 48 should be less than that exhibited at the interface between the opposed surfaces of the remainder of the layers forming the laminate, in order to facilitate distribution of the processing composition intermediate layers 48 and 56. The laminate's structural integrity may also be enhanced or provided, in whole or in part, by providing a binding member extending around, for example, the edges of the film unit.

Rupturable container 11 may be of the type shown and described in any of U.S. Pat. Nos. 2,543,181; 2,634,886; 3,653,732; 2,723,051; 3,056,492; 3,056,491; 3,152,515; and the like. In general, such containers will comprise a rectangular blank of fluid and air-impervious sheet material folded longitudinally upon itself to form two walls which are sealed to one another along their longitudinal and end margins to form a cavity in which photographic processing composition is retained. The longitudinal marginal seal is made weaker than the end seals so as to become unsealed in response to the hydraulic pressure generated within the fluid contents of the container by the application of compressive pressure to the walls of the container.

The terms "small grain" and "large grain" are relative terms, used for convenience in describing the film unit and are intended to refer to the size of the grains in one layer of the silver halide unit compared to the size of the grains in the other layer of the same silver halide unit. The actual size of the grains will be selected according to the parameters set forth above.

Preferably, the difference in the average mean grain size between the first and second silver halide layer ranges from about 0 to 2.0, more preferably 0.5 to 0.9$\mu$.

Preferably, the second silver halide layer, i.e., the layer closest to the exposure surface, possesse a higher intrinsic speed than the first silver halide layer. More preferably, the speed difference is at least about 2 stops and may range up to about 8 stops. In a particularly preferred embodiment, the difference is about 5 stops.

The preferred inert particles are obtained from polymeric latices known to the art. The following non-limiting example illustrates the preparation of a latex preferred for use in the present invention.

EXAMPLE A

| | | |
|---|---|---|
| Water | 188 | l. |
| Methylmethacrylate | 51 | kg. |
| Potassium persulfate | 0.15 | kg. |
| Ascorbic acid | 0.01 | kg. |
| Dowfax 2Al 20% solution (dodecyldiphenyl oxide disulfonate sodium salt, sold by Dow Chemical Co., Midland, Michigan) | 1.275 | kg. |

A reactor was charged with 102 l. of demineralized water and the Dowfax 2A1 and heated under nitrogen to 83° C. whereupon 7.65 kg. of methylmethacrylate was added and mixed until the temperature returned to 83° C. After 5 min. at 83° C., 4.93 kg. of initiator solution (0.15 kg. of potassium persulfate and 14.79 kg. water) was added. After the exotherm the temperature was reduced to 85° C. and the remaining methylmethacrylate was added at a rate of about 361 g/min. and the remaining initiator solution at a rate of about 111 g/min. At the end of the monomer and initiator addition, the temperature was maintained at 85° C. for 10 min. and then the ascorbic acid was added. The resulting latex had a 30% solids and about a 0.125$\mu$ average particle size.

The following non-limiting example illustrates the novel film unit of the present invention:

EXAMPLE 1

A photosensitive element was prepared by coating, in succession, on a gelatin subbed, opaque polyethylene terephthalate film base, the following layers:

1. a layer comprising the cyan dye developer

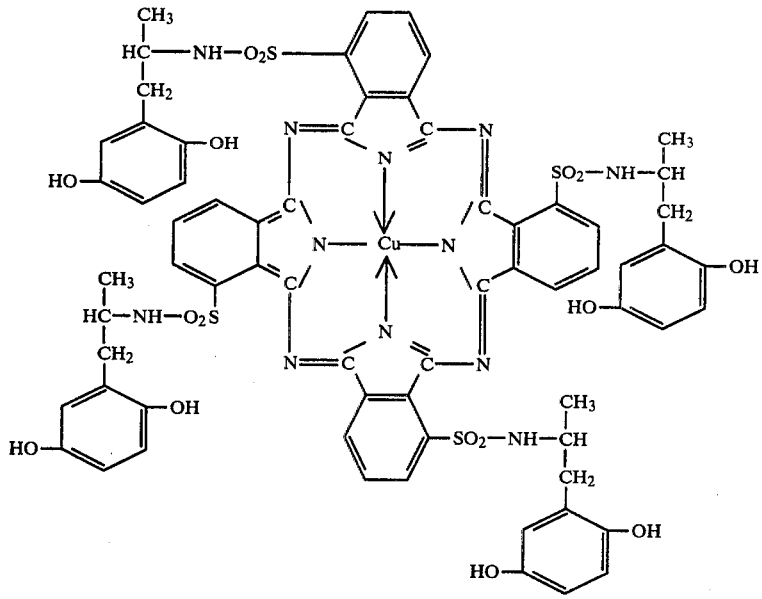

dispersed in gelatin and coated at a coverage of about 747 mgs/m$^2$ of dye, about 1554 mgs/m$^2$ of gelatin, about 270 mgs/m$^2$ of 4'-methylphenyl-hydroquinone, and about 270 mgs/m$^2$ of 2-phenyl benzimidazole;

2. a red-sensitive silver halide unit comprising a first layer of about 1.05$\mu$ average mean diameter silver iodobromide grains at a coverage of about 640 mgs/m$^2$ of silver, and about 282 mgs/m$^2$ of gelatin; and a second layer of about 1.8$\mu$ average mean diameter silver iodobromide grains at a coverage of about 640 mgs/m$^2$ of silver and about 282 mgs/m$^2$ of gelatin;

3. an interlayer coated at a coverage of about 2484 mgs/m$^2$ of a 60-30-4-6 tetrapolymer of butylacrylate, diacetone acrylamide, styrene and methacrylic acid, and about 77 mgs/m$^2$ of polyacrylamide permeator;

4. a layer comprising the magenta dye developer

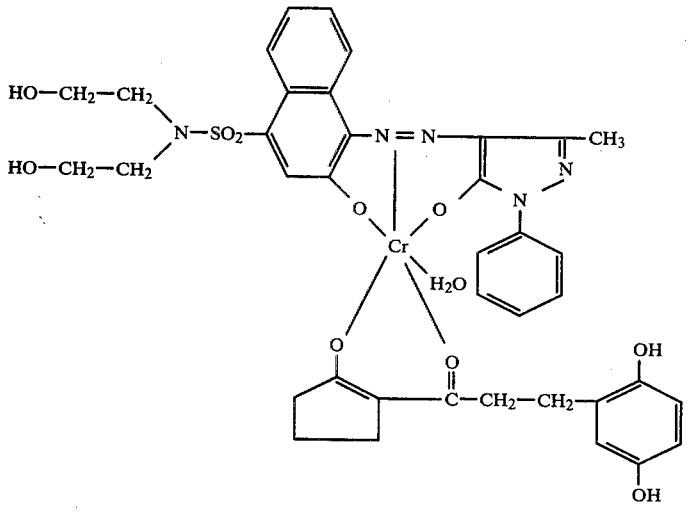

dispersed in gelatin and coated at a coverage of about 646 mgs/m$^2$ of dye and about 284 mgs/m$^2$ of gelatin and about 208 mgs/m$^2$ of 2-phenylbenzimidazole;

5. a green-sensitive silver halide unit comprising a first layer of 1.05$\mu$ average mean diameter silver iodobromide grains coated at a level of about 387 mgs/m$^2$ of silver and about 160 mgs/m$^2$ of gelatin; a layer comprising polymethylmethacrylate latex having an average particle size of about 0.125$\mu$ at a coverage of 2160 mgs/m$^2$ (solids) and polyacrylamide at a coverage of about 108 mgs/m$^2$; and a second layer of 1.8$\mu$ average mean diameter silver iodobromide coated at a level of about 409 mgs/m$^2$ of silver and about 180 mgs/m$^2$ of gelatin; with the speed difference between the first and second silver halide layers about 5 stops;

6. an interlayer layer containing the tetrapolymer referred to above in layer 3 at a coverage of about 1369 mgs/m$^2$, about 24 mgs/m$^2$ of polyacrylamide, and about 75 mgs/m$^2$ succindialdehyde;

7. a layer comprising the yellow dye developer

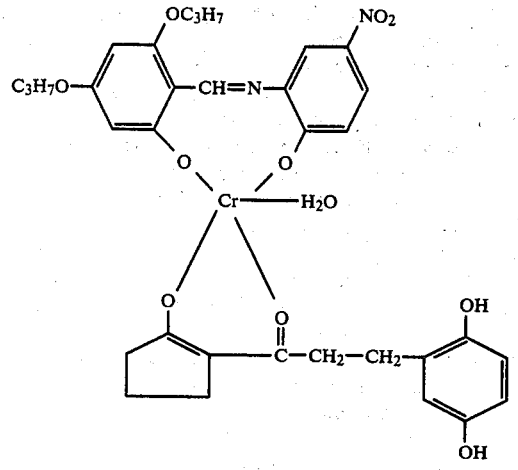

dispersed in gelatin and coated at a coverage of about 968 mgs/m$^2$ of dye and about 450 mgs/m$^2$ of gelatin and about 208 mgs/m$^2$ of 2-phenyl benzimidazole;

8. a blue-sensitive gelatino silver iodobromide emulsion layer coated at a coverage of about 1280 mgs/m$^2$ of silver, about 743 mgs/m$^2$ of gelatin, and about 204 mgs/m$^2$ of 4'-methylphenylhydroquinone;

9. an overcoat layer coated at a coverage of about 484 mgs/m$^2$ of gelatin and 43 mgs/m$^2$ of carbon black.

An image-receiving element was prepared by coating the following layers in succession on a 4 mil polyethylene terephthalate film base, said layers respectively comprising:

1. as a polymeric acid layer, the partial butyl ester of polyethylene/maleic anhydride copolymer at a coverage of about 28,000 mgs/m$^2$;

2. a timing layer containing about a 75:1 ratio of a 60-30-4-6 copolymer of butylacrylate, diacetone acrylamide, styrene and methacrylic acid and polyvinylalcohol at a coverage of about 5600 mgs/m$^2$; and 3. a polymeric image-receiving layer containing a 2:1 mixture, by weight, of polyvinyl alcohol and poly-4-vinylpyridine, at a coverage of about 3300 mgs/m$^2$.

An aqueous alkaline solution was prepared comprising the following basic formulation:

| | weight % |
|---|---|
| Potassium hydroxide | 4.98 |
| N—phenethyl—α-picolinium bromide (50% solution in water) | 1.22 |
| Sodium carboxymethyl hydroxyethyl cellulose (Hercules Type 420H) | 1.70 |
| Titanium dioxide | 35.9 |
| 6-methyl uracil | 0.8 |
| 2-(benzimidazole methyl)—sulfide | 0.015 |
| 3,5-dimethylpyrazole | 1.75 |
| Colloidal silica aqueous dispersion (30% $SiO_2$) | 1.50 |
| N—2-hydroxyethyl-N,N',N'—tris-carboxymethyl—ethylene diamine | 0.25 |
| 4-amino pyrazolo—3,4-pyrimidine | 0.25 |
| 1-methylimidiazole | 1.75 |
| Water | 50.75 |

-continued

| | weight % |
|---|---|
| 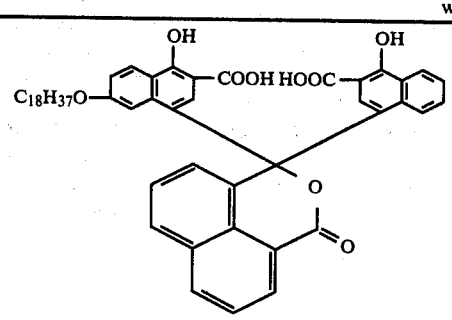 | 1.5 |
| 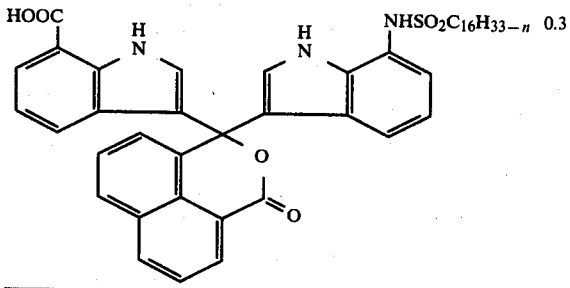 | 0.3 |

As a control, the above-film unit was prepared with the only difference being the absence of the polymer latex particle spacer layer.

The film units were processed in the following manner:

The film unit was exposed to white light to a multicolor target and the processing composition was spread between the two elements which were maintained together in a layer approximately 0.0028" thick in the dark.

The following sensitometer data was obtained in the resulting multicolor reflection prints:

TABLE

| | CONTROL | | | EXAMPLE 1 | | |
|---|---|---|---|---|---|---|
| | Red | Green | Blue | Red | Green | Blue |
| $D_{max}$ | 2.30 | 2.12 | 2.22 | 2.24 | 2.03 | 2.20 |
| Speed | 1.41 | 1.64 | 1.64 | 1.37 | 1.54 | 1.59 |
| Slope | 1.81 | 2.02 | 1.95 | 1.64 | 1.50 | 1.61 |
| Toe Extent | 31 | 35 | 44 | 34 | 45 | 52 |
| Dynamic Range | 22 | 15 | 17 | 27 | 24 | 20 |

From the above table it will be seen that the significant advantages of the present invention are found in the Toe Extent and particularly in the Slope. In addition, more magenta and yellow saturation was obtained and the effectiveness of the emulsions to control dye transfer was enhanced.

The advantages of the present invention are not obtained merely by spacing the emulsions within a silver halide unit. The spacer must comprise the inert particles described above. For example, spacers such as gelatin, polyvinyl alcohol or interlayers of the type set forth in layers 3 and 6 above do not function in the same manner as the particle spacer layers of the present invention; i.e., they do not develop independently as determined by Developgraph data; nor do they provide the dye control or speed obtained by means of the present invention.

Similarly, inert particles larger than 2.5μ did not function satisfactorily. A spacer layer consisting of about 430 mgs/m$^2$ of aluminum oxide particles having a mean diameter about 3.8$\mu$ were employed in a film unit of the above description. The coating was not uniform and some disruption of the negative was observed; i.e., the particles punctured into adjacent layers. The photographic advantages achieved by the present invention were not obtained with the relatively large aluminum oxide particles. Silicon dioxide particles about 5$\mu$ in meand diameter were also examined as the spacer layer; extreme disruption of the adjacent negative layers occurred.

What is claimed is:

1. A photosensitive element for use in a diffusion transfer film unit which comprises a support carrying;

(a) a first silver halide emulsion layer (b) a second silver halide emulsion layer;

said first and second silver halide emulsion layers being sensitive to substantially the same spectral absorption range and having associated therewith a material which provides a dye image-forming material which is diffusible during processing as a function of the point-to-point degree of silver halide exposure to actinic radiation;

(c) a spacer layer intermediate and contiguous to said first and second silver halide emulsion layers;

said spacer layer consisting essentially of inert particles which are substantially non-swelling in alkali and substantially non-film forming; said particles being less than or equal to the silver halide grains in average diameter; said silver halide grains being 2.5$\mu$ or less in average diameter.

2. The element of claim 1 wherein said particles are derived from a polymeric latex.

3. The element of claim 2 wherein said polymer is polymethylmethacrylate.

4. The element of claim 2 wherein said polymer is polystyrene.

5. The element of claim 1 wherein said spacer includes a polymer binder adapted to promote integrity of said spacer layer.

6. The element of claim 5 wherein said polymer binder is polyacrylamide.

7. The element of claim 1 wherein said first silver halide emulsion layer comprises grain of a first mean particle size and said second silver halide emulsion layer contains grains of a second mean particle size.

8. The element of claim 1 wherein said first and second silver halide layers are free of dye image-forming material.

9. The element of claim 1 wherein the thickness of said spacer layer is 0.5 to 10 times (weight basis) as the individual silver halide layers.

10. The element of claim 9 wherein said spacer layer is 4 times (weight basis) as the individual silver halide layer.

11. The element of claim 10 wherein there is a difference in speed between said first and second silver halide emulsion layers.

12. The element of claim 1 wherein the speed difference between said first and second silver halide layers ranges from about 2 to about 8 stops.

13. The element of claim 12 wherein said speed difference is about 5 stops.

14. The element of claim 1 wherein said dye image forming material is a dye developer.

15. A photographic diffusion transfer film unit comprising a support carrying at least one photosensitive element comprising a first and second photosensitive silver halide layer and a dyeable receiving layer adapted to receive a dye image diffusing thereto after photoexposure and processing of said photosensitive element; said first and second silver halide layers being sensitive to substantially the same spectral absorption region; said first and second photosensitive silver halide layers having associated therewith a material which provides a dye image forming material which is diffusible during processing as a function of the point-to-point degree of silver haide exposure to actinic radiation; and, intermediate and contiguous to said first and second photosensitive silver halide layers, a spacer layer consisting essentially of particles which are substantially non-swelling in alkali, and substantially non-film forming; said particles being less than or equal to the silver halide grains in average diameter; said silver halide grains being 2.5$\mu$ or less in average diameter.

16. The film unit of claim 15 wherein said unit particles are derived from a polymer latex.

17. The film unit of claim 15 wherein said polymer is polymethylmethacrylate.

18. The film unit of claim 15 wherein said polymer is polystyrene.

19. The film unit of claim 15 wherein said spacer includes a polymer binder adapted to promote integrity to said spacer layer.

20. The film unit of claim 19 wherein said second polymer is polyacrylamide.

21. The film unit of claim 15 wherein said first and second silver halide layers are free of dye image forming material.

22. The film unit of claim 15 wherein the thickness of said spacer layer is 0.5 to 10 times (weight basis) as the individual silver halide layers.

23. The film unit of claim 22 wherein said spacer layer is 4 times (weight basis) as the individual silver halide layer.

24. The film unit of claim 15 wherein said first silver halide emulsion layer comprises grains of a first mean particle size and said second silver halide emulsion layer possesses grains of a second mean particle size.

25. The film unit of claim 15 wherein there is a difference in speed between said first and second silver halide emulsion layers.

26. The film unit of claim 25 wherein the speed difference between said first and second silver halide layers ranges from about 2 to about 8 stops.

27. The film unit of claim 26 wherein said speed difference is about 5 stops.

28. The film unit of claim 15 wherein said dye image forming material is a dye developer.

29. The film unit of claim 15 which includes a rupturable container of processing composition adapted to discharge its contents between a predetermined pair of layers.

30. The film unit of claim 29 wherein said dyeable receiving layer is adapted to be superposed over the silver halide emulsion layer subsequent to photoexposure and adapted to be separated therefrom after processing.

31. The film unit of claim 30 which provides a permanent laminate wherein the image is viewable in said receiving layer without separation of said receiving layer from said film unit.

32. A photographic film unit which comprises, in combination:

a photosensitive element having a diffusion transfer image-receiving element affixed to at least one edge thereof is superposed or superposable relationship, said photosensitive element comprising a support carrying:

(a) a red-sensitive silver halide unit having associated therewith a cyan dye developer;

(b) a green-sensitive silver halide unit having associated therewith a magenta dye developer;

(c) a blue-sensitive silver halide unit having associated therewith a yellow dye developer; wherein at least one of said silver halide units comprises, (1) a first silver halide emulsion layer and (2) a second silver halide emulsion layer;

sad first and second photosensitive silver halide layers being sensitive to substantially the same spectral absorption range, a spacer layer intermediate and contiguous to photosensitive silver halide layers, said spacer layer consisting essentially of polymer latex particles which are substantially non-swelling in alkali, and substantially non-film forming; said particles being less than or equal to the silver halide grains in average diameter; said silver halide grains being 2.5μ or less in average diameter.

33. The film unit of claim 32 including a rupturable container retaining an aqueous alkaline processing composition and adapted to discharge its contents intermediate said superposed photosensitive and image-receiving elements.

34. The film unit of claim 32 wherein the support layer of said image-receiving element is transparent.

35. The film unit of claim 34 in which said unit is a composite structure comprising said photosensitive element and said image-receiving element affixed to the other in superposed relationship, the support layers of each of said elements being outermost.

36. The film unit of claim 32 wherein said polymer is polymethylmethacrylate.

37. The film unit of claim 32 wherein said polymer is polystyrene.

38. The film unit of claim 32 wherein said spacer includes a polymer binder adapted to promote integrity to said spacer layer.

39. The film unit of claim 38 wherein said polymer is polyacrylamide.

40. The film unit of claim 32 wherein said first and second silver halide layers are free of dye developer.

41. The film unit of claim 32 wherein the thickness of said spacer layer is 0.5 to 10 times (weight basis) as the individual silver halide layers.

42. The film unit of claim 41 wherein said spacer layer is 4 times (weight basis) as the individual silver halide layer.

43. The film unit of claim 32 wherein there is a speed difference between said first and second photosensitive silver halide layers of about 2 to 8 stops.

44. The film unit of claim 43 wherein said speed difference is about 5 stops.

* * * * *